United States Patent [19]

Hebert et al.

[11] 4,220,170

[45] Sep. 2, 1980

[54] APPARATUS FOR CLEANING LARGE TANK INTERIORS

[76] Inventors: Chris J. Hebert; Ralph T. Hollister, both of 157 N. Leo, Baton Rouge, La. 70806; C. Downing Sweat, Jr., 4627 Tartan Dr., Baton Rouge, La. 70816

[21] Appl. No.: 62,041

[22] Filed: Jul. 30, 1979

Related U.S. Application Data

[63] Continuation-in-part of Ser. No. 36,439, May 7, 1979, which is a continuation-in-part of Ser. No. 851,342, Nov. 14, 1978, Pat. No. 4,163,455.

[51] Int. Cl.[3] ..... B08B 9/08; B08B 3/02

[52] U.S. Cl. ..... 134/167 R; 134/172; 239/165; 239/227

[58] Field of Search ..... 134/167 R–168 R, 134/172, 180–181, 198; 239/165, 187, 227, 246, 264, 265

[56] References Cited

U.S. PATENT DOCUMENTS

| | | | |
|---|---|---|---|
| 3,074,649 | 1/1963 | Atkinson | 239/227 X |
| 3,153,510 | 10/1964 | Brännfors et al. | 239/165 X |
| 3,897,263 | 7/1975 | Davis et al. | 239/187 X |
| 3,957,203 | 5/1976 | Bullard | 239/165 X |
| 4,163,455 | 8/1979 | Hebert et al. | 134/167 R |

FOREIGN PATENT DOCUMENTS

| | | | |
|---|---|---|---|
| 2352592 | 1/1978 | France | 134/172 |

*Primary Examiner*—Robert L. Bleutge
*Attorney, Agent, or Firm*—Roy, Kiesel, Patterson & McKay

[57] ABSTRACT

An apparatus for cleaning large tank interiors and other similar areas having a telescoping boom assembly attached to a base assembly with a positionable water nozzle assembly attached to one end of the boom assembly wherein the base member positioned in the tank interior is provided with a cage area housing the necessary control equipment and human operator.

9 Claims, 18 Drawing Figures

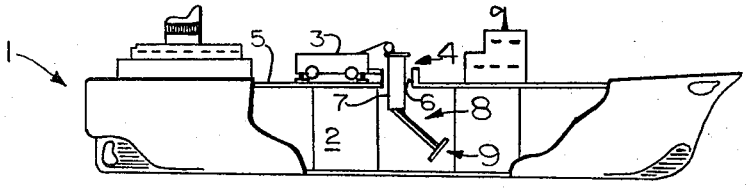
FIGURE 1
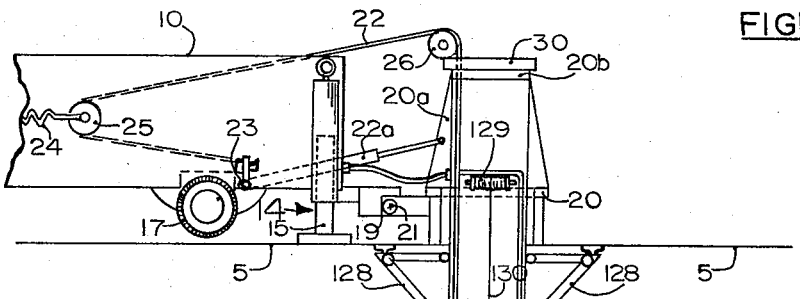
FIGURE 2
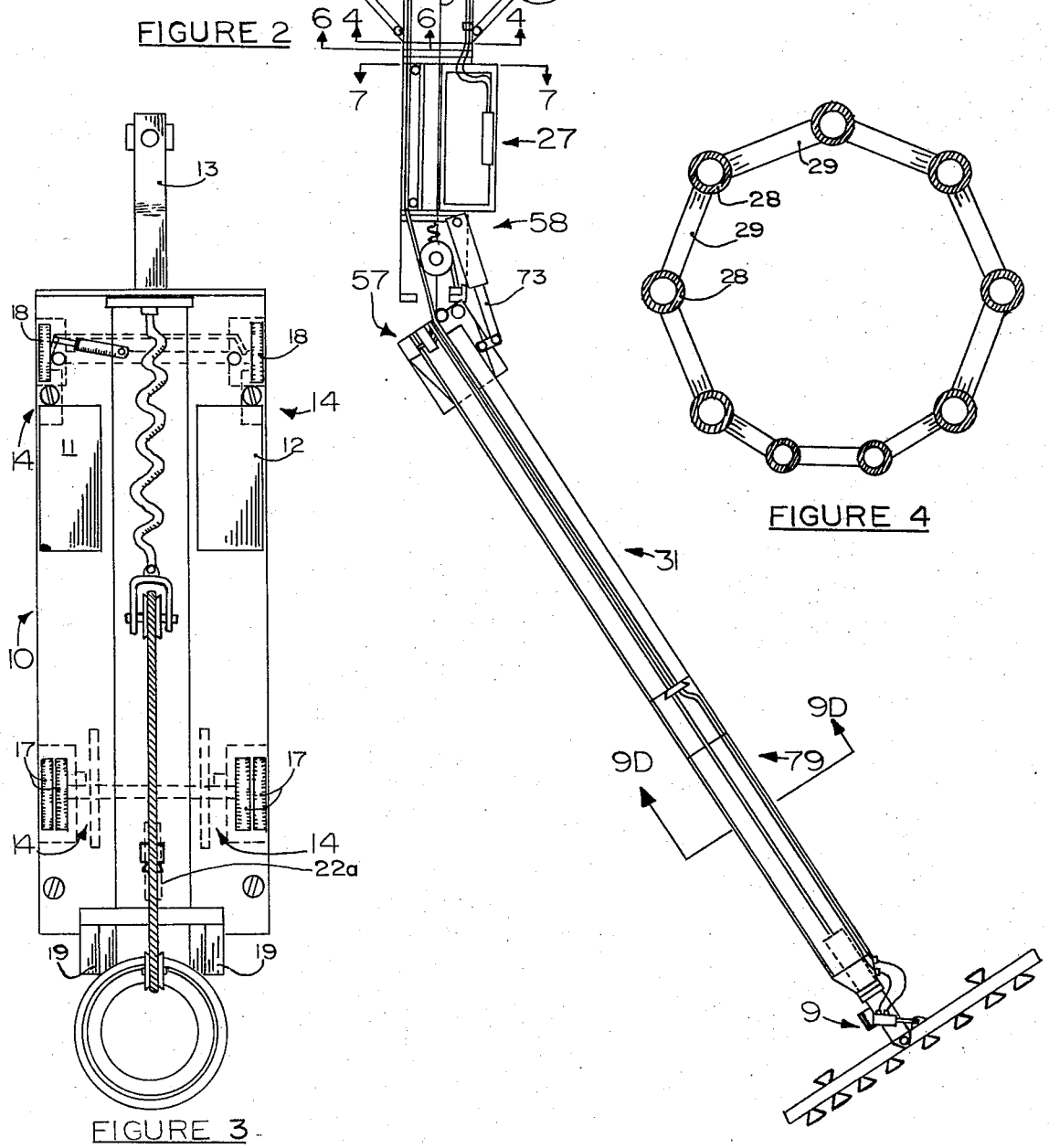
FIGURE 3
FIGURE 4

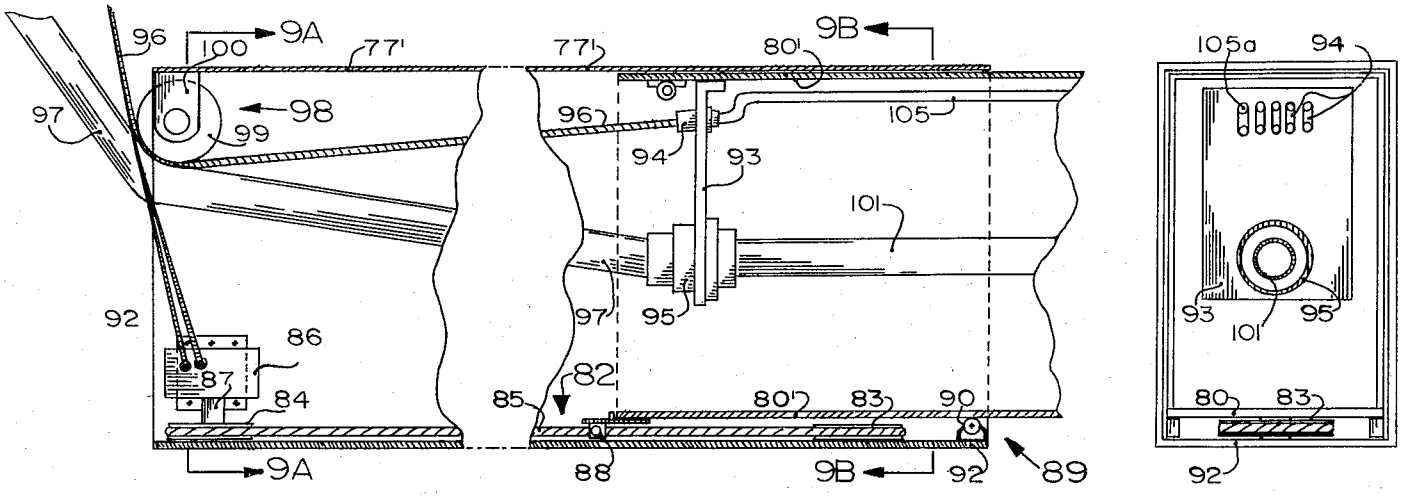
FIGURE 9
FIGURE 9B
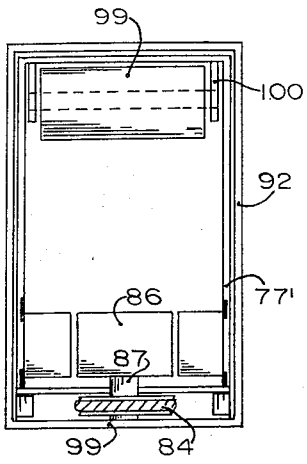
FIGURE 9A
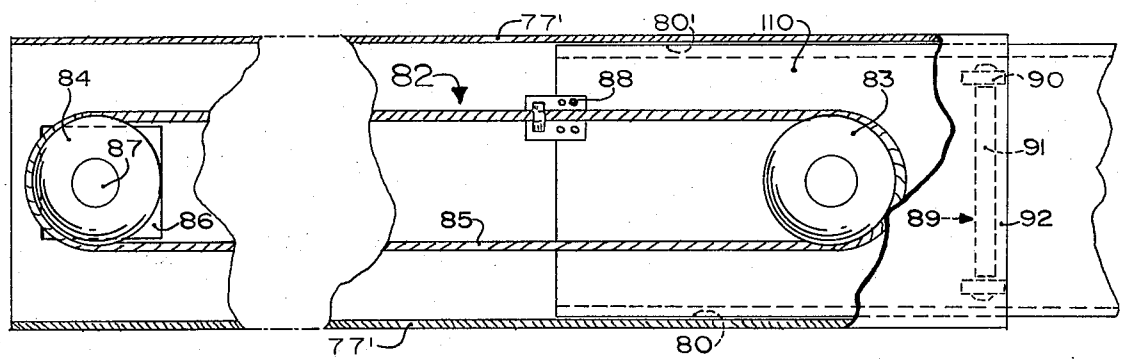
FIGURE 9C
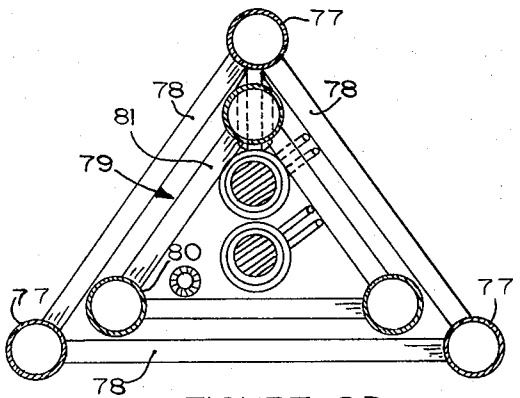
FIGURE 9D 116
117
118
122
121
123
126
125
124b
124
124a
105
10B
110
126'
127
115
101
103
104
102
108
107
106
80'
110'
109
112
113
114
117
118
119
120

80
107
108
109
102

APPARATUS FOR CLEANING LARGE TANK INTERIORS

RELATED APPLICATIONS

This application is a continuation-in-part of U.S. Pat. application Ser. No. 36,439 filed May 7, 1979, by Chris Joseph Hebert and Ralph Thomas Hollister, inventors herein, and entitled "Cleaning Apparatus for Ship Holds", which application is a contination-in-part of U.S. Patent application Ser. No. 851,342, filed Nov. 14, 1978, by Chris Joseph Hebert and Ralph Thomas Hollister, inventors herein, and entitled "Cleaning Apparatus for Ship Holds", now U.S. Pat. No. 4,163,455.

BACKGROUND OF THE INVENTION

1. Field of the Invention

This invention relates broadly to cleaning apparatus and, more particularly, to apparatus for cleaning large tank interiors.

2. Prior Art

The cleaning of interior walls of large tanks or holds in ships have presented many problems due to, in some cases, the shape and interference of structural beams, or the type of residue and scale left by corrosive or highly flammable materials, or the sheer size of the areas to be cleaned.

The present actual practice is quite archaic and consists of stationing crews of men inside the tank bottom or on scaffolding. The men are equipped with very high pressure water hoses to literally knock down and remove the scale and rust. Unfortunately, this practice is not only quite slow and less effective than desired, but also highly dangerous since the water stream of the hose can seriously injure or kill a person if he is struck by the stream.

Significant strides were made with the apparatus disclosed in the aforementioned related patent application, particularly in the areas of safety and more effective removal of scale and rust in ship cargo holds. However, apparatus which is lighter, better able to operate in more varied shaped large tank interiors and having better operative contol is desired.

SUMMARY OF THE INVENTION

Therefore, it is an object of this invention to provide an improved apparatus for cleaning the interior of large tanks, including ship holds.

Another object of this invention is to provide a sturdy but lighter weight apparatus for cleaning the interior of large tanks.

Still another object of this invention is to provide an apparatus for cleaning the interior of large tanks that is safe to the operator, but which permits better operative control of the positioning of the apparatus nozzle assembly.

Other objects and advantages of this invention shall become apparant from the ensuing descriptions of this invention.

Accordingly, an apparatus for cleaning large tank interiors is provided comprising support means for fixedly positioning a cleaning assembly suspended within the tank interior wherein the cleaning assembly comprises a boom housing unit having an operator cage assembly containing controls for operating the apparatus, a rotatable telescoping boom assembly and a positionably adjustable nozzle assembly having water nozzles attached thereto to direct water against the interior wall structure of the tank.

BRIEF DESCRIPTION OF THE DRAWINGS

FIG. 1 is a cutaway, three-dimensional view of a preferred embodiment of this invention employed for cleaning a hold of a ship.

FIG. 2 is a three-dimensional cutaway side view of a preferred embodiment of the mobile carrier base and cleaning assembly of this invention.

FIG. 3 is a top view of the mobile carrier base.

FIG. 4 is a cross-sectional view taken along lines 4—4 of FIG. 2 illustrating a preferred embodiment of the boom housing unit.

FIG. 9 is a partial cutaway three-dimensional side view of a preferred embodiment of the telescoping boom assembly of this invention.

FIG. 9A is end view taken along lines 9A—9A of FIG. 9.

FIG. 9B is an opposite end view taken along lines 9B—9B of FIG. 9.

FIG. 9C is a bottom partial three-dimensional view of FIG. 9.

FIG. 9D is a cross-section view taken along lines 9D—9D of FIG. 2.

PREFERRED EMBODIMENTS OF THE INVENTION

Figure 6:
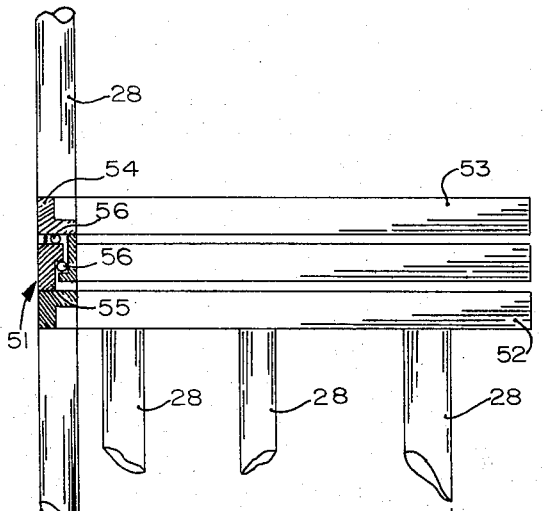
FIG. 6 is a cross-sectional view taken alongs lines 6—6 of FIG. 2 illustrating the bearing assembly separating the operating cage and upper support unit of the boom assembly.
Figure 7:
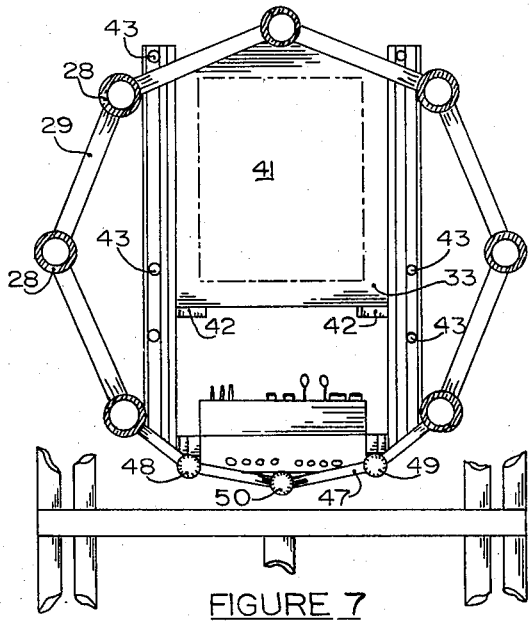
FIG. 7 is a top view of the operating cage taken along lines 7—7 of FIG. 2.
Figure 5A:
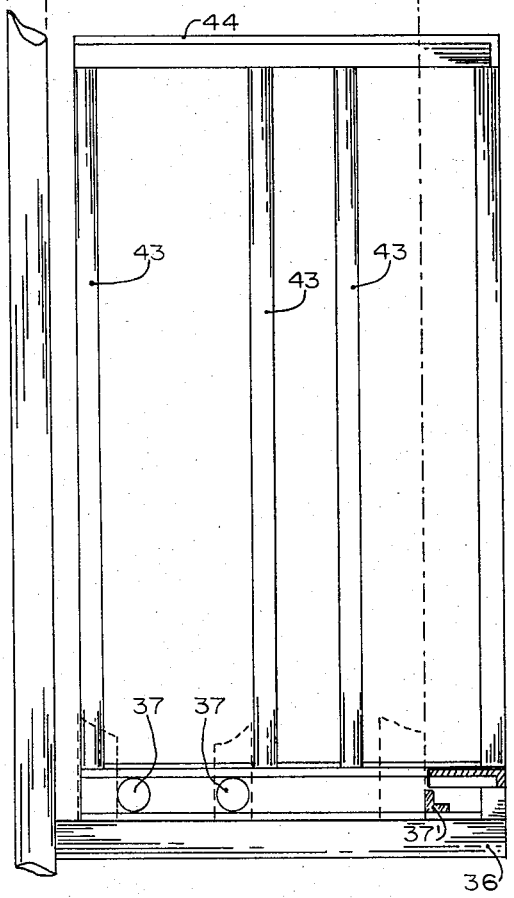
FIG. 5A is a partial cutaway three-dimensional side view of a preferred embodiment of the cage assembly of this invention.
Figure 5B:
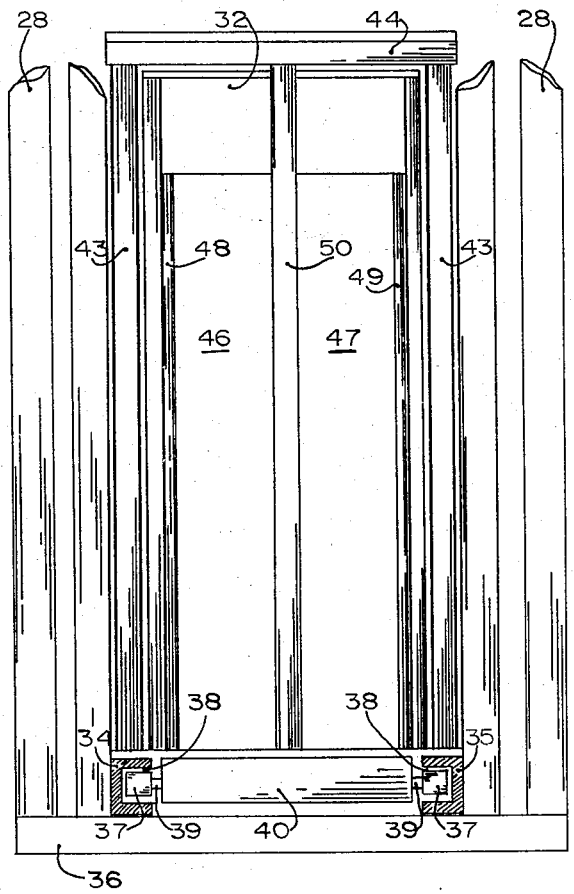
FIG. 5B is a partial cutaway three-dimensional front view of a preferred embodiment of the cage assembly of this invention.

Without any intent to limit the scope of this invention, the preferred embodiments of the cleaning apparatus are disclosed as utilized for the cargo hold of a ship. As is seen in FIG. 1, a cargo ship, generally denoted by the numeral 1, is provided with many cargo holds 2 which must be thoroughly cleaned of rust, scale and other matter after each trip. In such an arrangement, the mobile carrier base 3 to which is pivotedly mounted the cleaning assembly 4 is lifted by cranes (not shown) onto the deck 5 of ship 1 and moved to position the end of carrier base 3 over cargo hatch opening 6 where, as detailed below, boom housing unit 7 having cage assembly 27 along with telescoping boom assembly 8 and nozzle assembly 9 are positioned within cargo hold 2.

Turning now to FIGS. 2 and 3, a preferred embodiment of mobile carrier base 3 is seen. It comprises a cleaning assembly carrier bed 10 which houses the hydraulic pumps 11 and water pumps 12 necessary to operate the various parts of cleaning assembly 4 and is further provided a conventional goose-neck hitch means 13 for connecting mobile carrier base 3 to a truck or other vehicle (not shown).

In a preferred embodiment, carrier base 3 is provided with conventional hydraulically operated jack stabilizer units 14 on which carrier base 3 is supported when cleaning apparatus 4 is positioned and operated in cargo hold 2. When cleaning apparatus 4 is not in use, jack legs 15 are retracted into hollow sleeves 16 so that carrier base 3 rests on back wheels 17 and front wheels 18 which are also hydraulically raised and lowered.

Cleaning apparatus 3 is pivotedly attached to carrier base shoulder braces 19 by means of a hinge plate assembly consisting of members 20, 20*a*, 20*b* (in which cage assembly 7 slides) by pin rod 21 as shown in FIG. 2. In another preferred embodiment, the pivoting of cleaning apparatus 3 is controlled by hydraulic cylinder 22*a* which is attached at one end to hinged plate members 20, 20*a*, 20*b* and at its other end to attaching means 23 fixed to carrier bed 10. In a preferred embodiment, water hose 22 is maintained in a taut condition by spring 24 attached to pulleys 25 and 26 through which water hose 22 passes as shown in FIG. 2 to keep water hose 22 taut as booming assembly 8 telescopes.

Boom housing unit 7 is illustrated in FIGS. 2 and 4 having a circular cross-section formed by metal pipes 28 held rigidly in position by metal cross-bars 29. A top brace plate 30 on which sits pulley 26 attaches to each pipe 28. Boom housing unit 7 is of sufficient length and diameter to house main boom extension 31 when it is retracted into housing unit 7.

Included in boom housing unit 7 is cage assembly 27 where the control panel 32 and operator platform 33 are located as better seen in FIGS. 2 and 5–7. Cage assembly 27 is rollingly supported on metal channel iron beams 34 and 35 that are attached to circular metal plate 36 welded to pipes 28 and having a circular opening for main boom extension 31 to pass. The cage assembly 27 is provided with rollers 37 which fit into grooves 38 formed by beams 34 and 35 that allow cage assembly 27 to be rolled out until rollers 37 strike roller stop means 37'. Rollers 37 are rotatably connected to axles 39 attached to axle housing 40 that forms part of the cage flooring where the operator will stand. The flooring is, in a preferred embodiment, provided with a section 41 that can be pivotedly lifted around hinges 42 so that an opening is formed for main boom extension 31 to pass through when being retracted into the boom housing unit 7. The walls of the cage are formed from metal pipes 43 which are perpendicularly attached at their bottom ends to beams 34 and 35 and are connected at their top ends by metal tubing members 44. In a more preferred embodiment, the front of the cage has clear plexiglass partitions 46 and 47 and are connected to metal posts 48, 49 and 50. In this embodiment, control panels 32 is positioned at the top of the cage so that the operator can descend down the interior boom housing unit frame structure, roll the cage assembly out, put hinged floor section 41 down and enter the cage assembly.

In a preferred embodiment, cage assembly 27 and the lower part of pivot assembly 57 is designed to rotate 180° either direction to allow the operator to visually see the cleaning operation and to provide horizontal positioning of nozzle assembly 9. In this embodiment, pipes 28 are sectional and separated by a bearing assembly 51 as seen in FIG. 6. To provide a rigid structure, ring plates 52 and 53 are attached to the separated ends of pipes 28. Bearing collars 54 and 55 with bearings 56 are then conventionally attached to ring plates 52 and 53 as shown.

Figure 8A:
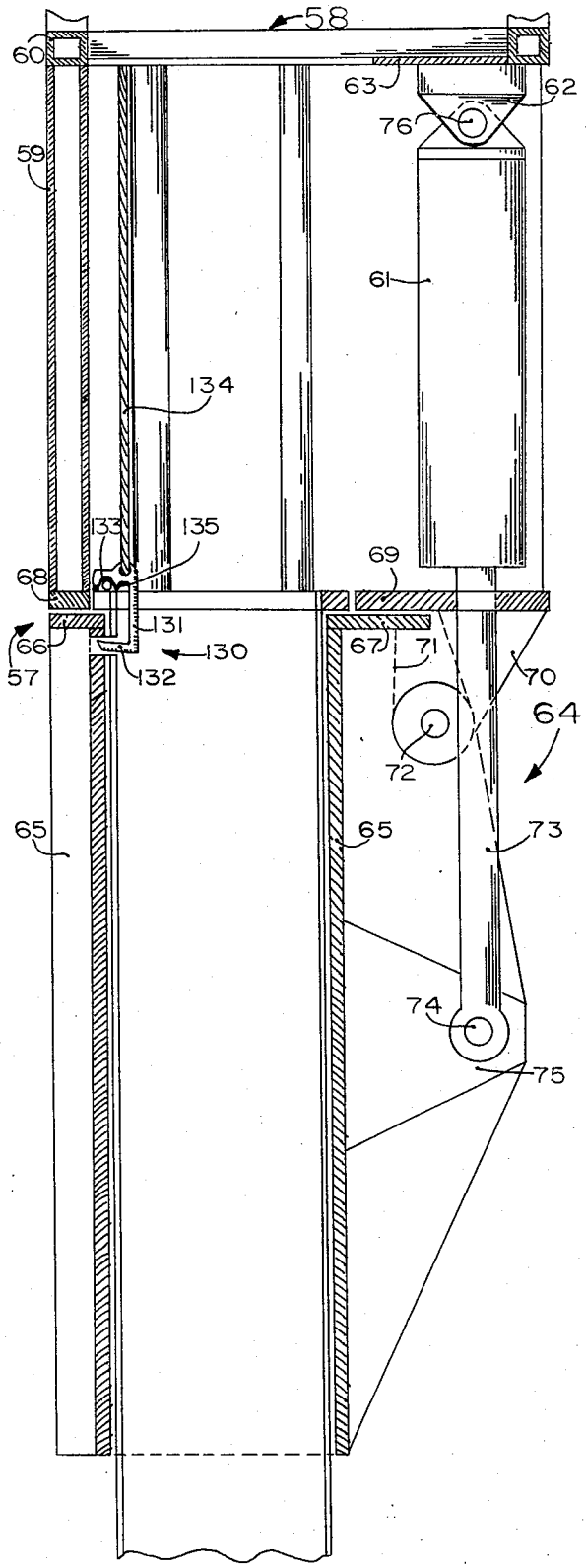
FIG. 8A is a cutaway three-dimensional side view of a preferred embodiment of the boom vertical pivot assembly.
Figure 8B:
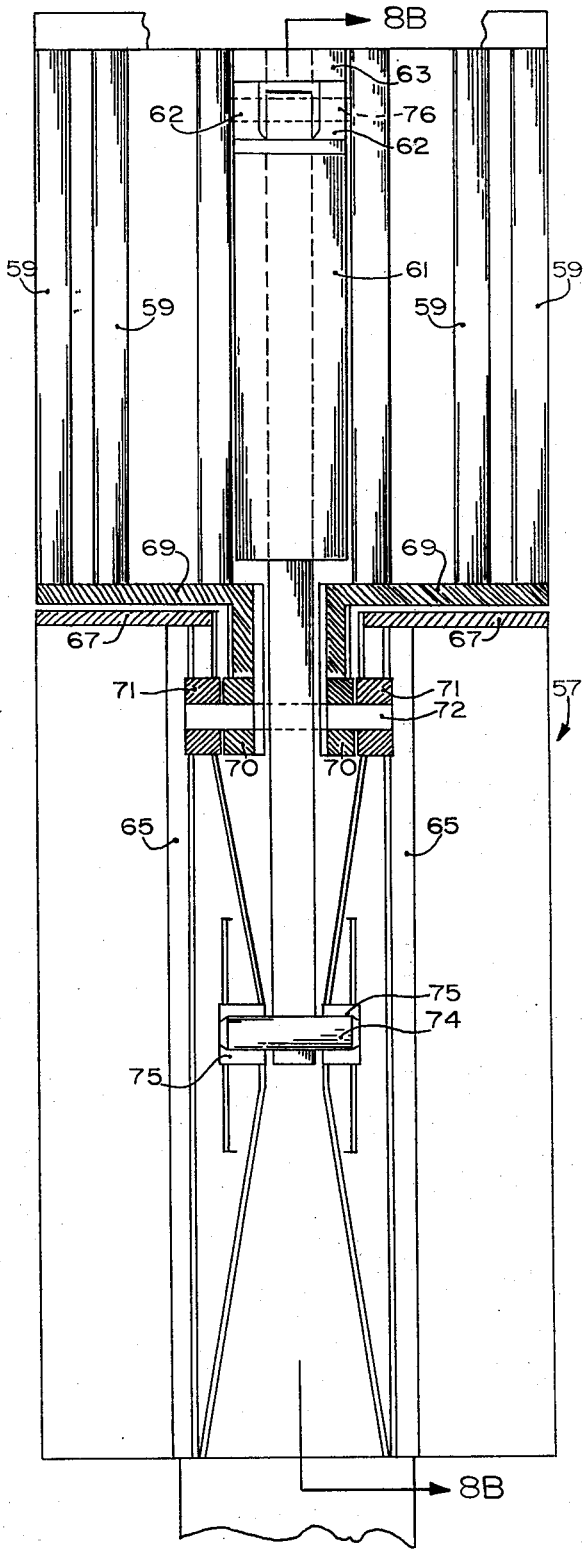
FIG. 8B is a cutaway three-dimensional front view of a preferred embodiment of the boom vertical pivot assembly.

Turning now to FIG. 8, the boom vertical pivot assembly 57 is attached to the bottom of cage assembly 27. Pivot assembly 57 comprises a hydraulic cylinder housing 58 formed from vertical metal posts 59 held rigidly in position by horizontal bars 60. Hydraulic cylinder 61 is pivotly attached between parallel pivot shoulder members 62 connected to plate 63. Below housing 58 is pivoting structure 64 having a boom support frame constructed from vertical support rods 65 having upper plate members 66 and 67 that fit flush with plate members 68 and 69, respectively, of housing 58 when main boom extension 31 is in a vertical position. Locking means 130 is provided to hold the main boom extension 31 in boom support frame. As seen in FIG. 8A, locking means assembly 130 comprises a boom lock 131 having catch 132, which extends below and about upper plate members 66 and which boom lock assembly is pivotedly mounted between shoulder members 135 and attached thereto by pin 133. Boom lifting cable 134 is attached to boom lock 131 to release catch 132 when it is desired to unlock the main boom extension 31. Parallel pivot shoulder plates 70 are perpendicularly attached to plate member 69 and extend between parallel shoulder plates 71. The pair of shoulder plates are pivotedly attached by pin 72. Piston rod 73 is pivotedly attached by pin 74 between parallel plates 75 perpendicularly attached to vertical support rods 65 as shown. In this embodiment, as rod 73 is contracted back into cylinder 61, pivoting structure 64 is forced from the vertical as it pivots about pin 72 and as hydraulic cylinder 61 pivots about pin 76.

Main boom extension 31, shown in FIGS. 9 and 9A–D, is either triangular in shape, as shown in FIG. 9D, formed by three main metal tubes 77 rigidly fixed in position from one another by metal cross braces 78 resulting in a center cavity that lower boom extension 79 can retract into or rectangularly shaped as seen in FIGS. 9A–9C. It is preferred that tubes 77 be of sufficient length to allow lower boom extension 79 to retract completely within the cavity. Lower boom extension 79 is similarly constructed from metal posts 80 and cross members 81. When main boom extension 31 and lower boom extension 79 are rectangular in cross-section as is seen in FIGS. 9, 9A, 9B and 9C, lower boom extension 79 into the main boom extension 31 is boom length adjusting cable assembly 82 comprising pulleys 83 and 84 attached to metal plate 92 attached to steel braces 77' and having a cable 85 fixed thereto and turned by motor 86 having axle 87 to which pulley 84 is fixedly connected. Cable 85 is fixedly attached to plate 110 connected between braces 80' of lower boom extension 79 by cable clamp 88. Thus, as cable 85 is driven around pulleys 83 and 84, lower boom extension 79 is raised or lowered into main boom extension 31. In a preferred embodiment, roller assemblies 89, having rollers 90, are rotatably attached to flat metal plates 92 attached between braces 77', axle 90 and axle mount 91.

Also attached to plate 110 is support member 93 having hydraulic and electric line couplings 94 and water hose couplings 95 attached thereto where flexible hydraulic and electric conduit 96 and flexible water hose 97 attach. In a preferred feature, roller assembly 98, provided with roller 99, is attached to braces 77' between shoulder members 100 in order that conduit 96 and hose 97 are guided and do not become entangled in the boom structure.

Extending below support member 93 is rigid water pipe 101 attached at one end to coupling 95 to receive pressurized water from flexible hosing 97 and connected at its other end to tubing 102 by flanges 103 and 104. Also extending below support member 93 are rigid conducts 105 attached to coupling 94 and housing the hydraulic and electrical lines **105*a* and 105*b***, respectively.

Pivotedly attached to post 80 at a position below flange 104 is nozzle manifold rotational positioner 106 comprising a hydraulic jack 107 havng a rod 108 attached to tubing 102 by attaching means 109. By extending and retracting rod 108 into jack 107, tubing 102 can be made to rotate the desired position.

Figures 10, 10A, 10B:
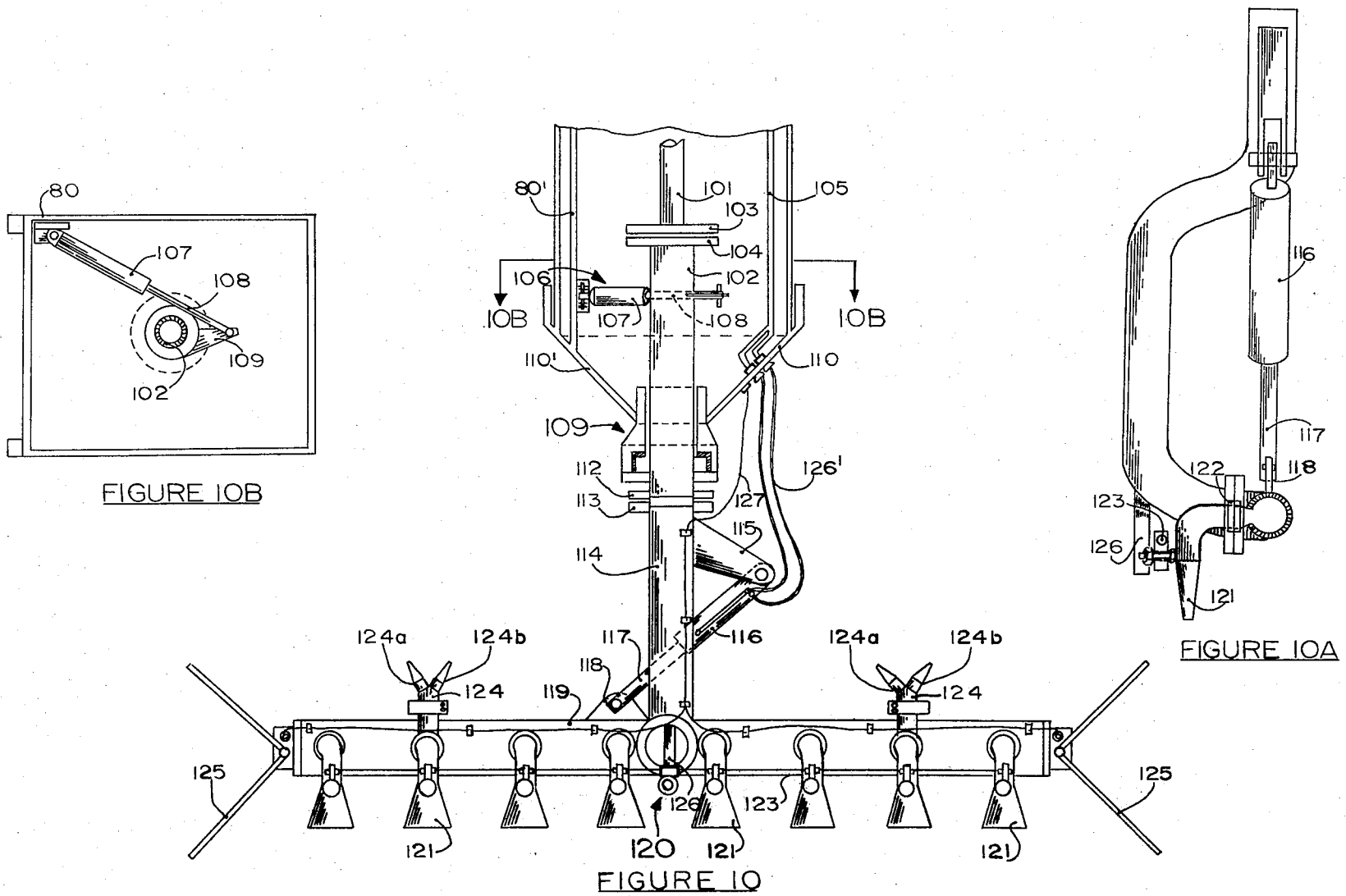
FIG. 10 is a partial cutaway three-dimensional view of a preferred embodiment of the nozzle assembly of this invention.
FIG. 10A is a three dimensional view of a preferred embodiment of the nozzle manifold swivel joint.
FIG. 10B is a top view taken along lines 10B—10B of FIG. 10 showing a preferred embodiment of the nozzle manifold rotational positioner.

In a preferred embodiment, tubing 102 is held in position parallel to lower boom extension 79 by attaching means 109 attached to end housing 110' that are attached to lower boom extension 79 as shown in FIG. 10.

Nozzle assembly 111 is fixedly attached to the end of tubing 102 by bolting together at flanges 112 and 113. Nozzle assembly 111 comprises rigid water pipe 114 attached to flange 113 and having hydraulic cylinder attaching shoulder member 115 extending perpendicularly therefrom and to which is pivotedly attached nozzle manifold positioning hydraulic cylinder 116 whose rod 117 is pivotedly attached to shoulder member 118 perpendicularly extending from nozzle manifold arm 119.

In a preferred embodiment, a nozzle aligning rod assembly 120 is attached to nozzle manifold arm 119 to maintain the direction of nozzles 121 parallel to lower boom extension 79. Each nozzle 121 is swivelly attached to nozzle manifold arm 119 by nozzle swivel joint 122. Attached to each nozzle 121 is rod 123 that forms part of the nozzle pointing rod assembly 120. Rod 123 is held in position by rod assembly 120 attached to metal brace 126.

In another preferred embodiment, two back side cleaning nozzles 124 are provided on each side of the nozzle manifold arm 119, each with double nozzles **124*a* and 124*b* to help balance the sideload created by the pressurized water exiting nozzles 121. Each nozzle 124*a* and 124*b* are preferably positioned to be about 45° from the center line of nozzle 121 as shown. In still another preferred embodiment, sensing rods 125 are attached at each end of manifold arm 119 to signal the operator that a wall or other obstacle is near. In an alternate embodiment, the sensing rods 125** could be data gathering means for a computor which is programed to guide the nozzle assembly over a pre-set area.

Lines 126 and 127 provide the electrical and hydraulic fluid used to operate hydraulic cylinder 116 as well as back side nozzle 124 and sensing means 125.

In operation, nozzle assembly 9 is lowered into cargo hold 2 and then boom housing unit 7 with main boom extension 31 and lower boom extension 79 retracted therein is positioned in the hold. Boom housing unit 7 is then stabilized by extending out expandable leg supports 128 and securing them to the ship deck 5. Next, boom extensions 31 and 79 are lowered by boom means of a winch 129 and cable 130 and boom length adjusting cable 85. Once lowered, nozzle assembly 9 is then flanged to lower boom extension 79. The operator then climbs down through the center of boom housing unit where he can roll out cage assembly 27, lower cage floor 41 and climb inside. The operator can then position the nozzle assembly and nozzles by operating the various controls at his finger tips.

There are, of course, many alternate embodiments not particularly disclosed but which are intended to be included within the scope of this invention as defined by the following claims.

What we claim is:

1. An apparatus for cleaning large tank interiors comprising:

(a) a boom housing unit connectable to a support means for rigidly fixing said boom housing unit in a position in said interior, said boom housing unit having a cage assembly containing controls for operating said apparatus, said cage assembly being rollingly supported on parallel, separated channel iron beams attached to said boom housing unit whereby said cage assembly can extend beyond said boom housing unit;

(b) a rotatable telescoping boom assembly comprising:

(i) a main boom extension shaped to be retractable into said boom housing unit by retracting means attached to said main boom extension and said boom housing unit, and (ii) a lower boom extension retractably attached to said main boom extension and pivotedly mounted in an extended position to said main boom extension; and (c) a nozzle assembly rotatably attached to said lower boom extension, said nozzle assembly comprising a nozzle manifold having nozzles attached thereto, means to connect nozzles to a water source and drive means attached to said nozzle assembly for rotating said nozzle manifold.

2. An apparatus according to claim 1 wherein said boom housing unit is connectable to a mobile carrier base.

3. An apparatus according to claim 1 wherein said cage assembly is provided with a floor, a section of said floor being hingedly attached to said cage assembly to fold up when said cage assembly is contained in said boom housing unit.

4. An apparatus according to claim 1 wherein said cage assembly is provided with a front partition extending perpendicularly from the floor of said cage assembly, said partition being constructed from a see-through material.

5. An apparatus according to claim 1 wherein said lower boom extension is provided with a roller assembly attached thereto and having rollers rotatably extending out from said roller assembly in contact with a side panel of said main boom extension to facilitate retraction of said lower boom extension into said main boom extension.

6. An apparatus according to claim 5 wherein a rigid water pipe is attached to said lower boom extension and coupled at one end to said means and coupled at its other end to a flexible water hose, said flexible hose being connected to said water source.

7. An apparatus according to claim 1 wherein a nozzle aligning rod is attached at one end to said nozzles and at its other end attached to said nozzle manifold to maintain said nozzles parallel to said lower boom extension.

8. An apparatus according to claim 7 wherein each back side cleaning nozzles are attached to said nozzle manifold to receive water therefrom, said back side cleaning nozzles being positioned opposite end nozzles located closest to each end of said nozzle manifold.

9. An apparatus according to claim 8 wherein each back side cleaning nozzle comprises two water discharge nozzles positioned about 45° from a center line of said end nozzles.

* * * * *